US009758913B2

(12) United States Patent
Obregon

(10) Patent No.: US 9,758,913 B2
(45) Date of Patent: Sep. 12, 2017

(54) WASHING MACHINE APPLIANCE AND A METHOD FOR OPERATING THE SAME

(71) Applicant: General Electric Company, Schenectady, NY (US)

(72) Inventor: Roberto Obregon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1093 days.

(21) Appl. No.: 13/928,699

(22) Filed: Jun. 27, 2013

(65) Prior Publication Data

US 2015/0000047 A1 Jan. 1, 2015

(51) Int. Cl.

| | |
|---|---|
| ***D06F 39/00*** | (2006.01) |
| ***D06F 33/02*** | (2006.01) |
| *D06F 39/08* | (2006.01) |
| *D06F 37/30* | (2006.01) |

(52) U.S. Cl.

CPC ..... *D06F 33/02* (2013.01); *D06F 39/003* (2013.01); *D06F 37/304* (2013.01); *D06F 39/088* (2013.01); *D06F 2202/065* (2013.01); *D06F 2202/10* (2013.01); *D06F 2204/086* (2013.01); *D06F 2204/10* (2013.01)

(58) Field of Classification Search

CPC ..... D06F 39/003; D06F 33/02; D06F 39/087; D06F 2202/085; D06F 2202/10

USPC .. 68/12.04, 12.05, 12.02, 12.21, 12.19, 207, 68/12.23, 12.27, 12.12, 12.16; 8/159, 8/158, 137

See application file for complete search history.

(56) References Cited

U.S. PATENT DOCUMENTS

| | | | | | |
|---|---|---|---|---|---|
| 4,400,838 | A * | 8/1983 | Steers | D06F 39/003 | 68/12.19 |
| 4,503,575 | A * | 3/1985 | Knoop | D06F 39/003 | 68/12.05 |
| 5,144,819 | A * | 9/1992 | Hiyama | D06F 39/003 | 68/12.04 |
| 5,161,393 | A * | 11/1992 | Payne | D06F 39/003 | 68/12.04 |
| 5,208,931 | A * | 5/1993 | Williams | D06F 39/003 | 68/12.04 |
| 5,230,228 | A * | 7/1993 | Nakano | D06F 39/003 | 68/12.02 |
| 5,259,217 | A * | 11/1993 | Civanelli | D06F 39/003 | 68/12.02 |
| 5,768,729 | A * | 6/1998 | Cracraft | D06F 39/087 | 68/12.05 |
| 5,897,672 | A * | 4/1999 | Badami | D06F 39/003 | 68/12.04 |

(Continued)

*Primary Examiner* — David Cormier
*Assistant Examiner* — Thomas Bucci
(74) *Attorney, Agent, or Firm* — Dority & Manning, P.A.

(57) ABSTRACT

A washing machine appliance and a method for operating a washing machine appliance are provided. The method includes estimating a mass of articles within a wash chamber of a drum based at least in part on an inertia of the drum and articles within the wash chamber of the drum, gauging the mass of articles within the wash chamber of the drum based at least in part on a volume of water within a tub, and establishing a load type of articles within the wash chamber of the drum based at least in part on the mass of articles within the wash chamber of the drum from the step of estimating and the mass of articles within the wash chamber of the drum from the step of gauging.

12 Claims, 5 Drawing Sheets

(56) References Cited

U.S. PATENT DOCUMENTS

| | | | | |
|---|---|---|---|---|
| 6,023,950 | A * | 2/2000 | Battistella | D06F 39/003 68/12.04 |
| 6,038,724 | A * | 3/2000 | Chbat | D06F 39/003 68/12.04 |
| 6,842,929 | B2 | 1/2005 | Kim et al. | |
| 7,421,752 | B2 * | 9/2008 | Donadon | D06F 39/003 8/158 |
| 7,930,787 | B2 * | 4/2011 | La Belle | D06F 39/003 68/12.04 |
| 7,958,584 | B2 | 6/2011 | Suel, II et al. | |
| 9,243,987 | B2 * | 1/2016 | Chanda | G01N 9/00 |
| 2005/0015890 | A1 * | 1/2005 | Kim | D06F 33/02 8/158 |
| 2006/0107468 | A1 * | 5/2006 | Urbanet | D06F 39/003 8/158 |
| 2009/0241270 | A1 * | 10/2009 | La Belle | D06F 39/003 8/159 |

* cited by examiner

WASHING MACHINE APPLIANCE AND A METHOD FOR OPERATING THE SAME

FIELD OF THE INVENTION

The present subject matter relates generally to washing machine appliances and methods for operating washing machine appliances.

BACKGROUND OF THE INVENTION

Washing machine appliances generally include a tub for containing wash fluid, e.g., water, detergent, and/or bleach, during operation of such washing machine appliances. A drum is rotatably mounted within the tub and defines a wash chamber for receipt of articles for washing. During operation of such washing machine appliances, wash fluid is directed into the tub and onto articles within the wash chamber of the drum. The drum can rotate at various speeds to agitate articles within the wash chamber in the wash fluid, to wring wash fluid from articles within the wash chamber, etc.

During operating of certain washing machine appliances, a volume of water is directed into the tub in order to form wash fluid and/or rinse articles within the wash chamber of the drum. The volume of water can vary depending upon a variety of factors. Large loads can require a large volume of water relative to small loads that can require a small volume of water. Likewise, loads containing absorptive fabrics, such as cotton, can require a large volume of water relative to similarly sized loads containing certain synthetic fabrics, such as polyester or nylon.

To operate efficiently, the volume of water directed into the tub preferably corresponds or correlates to a size of a load of articles within the wash chamber of the drum and/or a load type of articles within the wash chamber of the drum. Thus, large volumes of water are preferably directed into the washing machine's tub for large loads or loads of highly absorptive articles in order to properly wash such loads. Conversely, small volumes of water are preferably directed into the washing machine's tub for small loads or loads of poorly absorptive articles in order to properly wash such loads. Directing an improper volume of water into the drum can waste valuable water and/or energy and can also hinder proper cleaning of articles within the wash chamber of the drum. However, accurately determining the size and/or type of a load of articles within the wash chamber of the drum can be difficult.

Accordingly, a method for operating a washing machine appliance that can assist with determining a mass of articles within a wash chamber of a drum of the washing machine appliance and a load type of articles within the wash chamber of the drum would be useful.

BRIEF DESCRIPTION OF THE INVENTION

The present subject matter provides a washing machine appliance and a method for operating a washing machine appliance. The method includes estimating a mass of articles within a wash chamber of a drum based at least in part on an inertia of the drum and articles within the wash chamber of the drum, gauging the mass of articles within the wash chamber of the drum based at least in part on a volume of water within a tub, and establishing a load type of articles within the wash chamber of the drum based at least in part on the mass of articles within the wash chamber of the drum from the step of estimating and the mass of articles within the wash chamber of the drum from the step of gauging.

Additional aspects and advantages of the invention will be set forth in part in the following description, or may be apparent from the description, or may be learned through practice of the invention.

In a first exemplary embodiment, a method for operating a washing machine appliance is provided. The washing machine appliance has a drum positioned within a tub. The drum defines a wash chamber for receipt of articles for washing. A motor of the washing machine appliance is configured for rotating the drum within the tub. The method includes rotating the drum with the motor, adjusting an angular velocity of the drum during the step of rotating, determining a first or second derivative of the angular velocity of the drum after the step of adjusting, estimating a mass of articles within the wash chamber of the drum based at least in part on the first or second derivative of the angular velocity of the drum from the step of determining, directing liquid into the tub until a volume of liquid fills the tub to a predetermined height, and establishing a load type of articles within the wash chamber of the drum based at least in part on the mass of articles within the wash chamber of the drum from the step of estimating and the volume of liquid from the step of establishing.

In a second exemplary embodiment, a washing machine appliance is provided. The washing machine appliance includes a tub and a drum rotatably mounted within the tub. The drum defines a wash chamber for receipt of articles for washing. The washing machine appliance also includes a valve and a spout extending between the valve and the tub. The spout is configured directing liquid from the valve into the tub. A motor is in mechanical communication with the drum. The motor is configured for selectively rotating the drum within the tub. A controller is in operative communication with the valve and the motor. The controller is configured for operating the motor in order to rotate the drum, adjusting an angular velocity of the drum with the motor after the step of operating, determining a first or second derivative of the angular velocity of the drum after the step of deactivating, estimating a mass of articles within the wash chamber of the drum based at least in part on the first or second derivative of the angular velocity of the drum from the step of determining, opening the valve in order to direct a flow of liquid into the tub, closing the valve in order to terminate the flow of liquid into the tub after a level of liquid within the tub reaches a predetermined height, calculating a volume of liquid within the tub after the step of closing, and establishing a load type of articles within the wash chamber of the drum based at least in part on the mass of articles within the wash chamber of the drum from the step of estimating and the volume of liquid within the tub from the step of calculating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
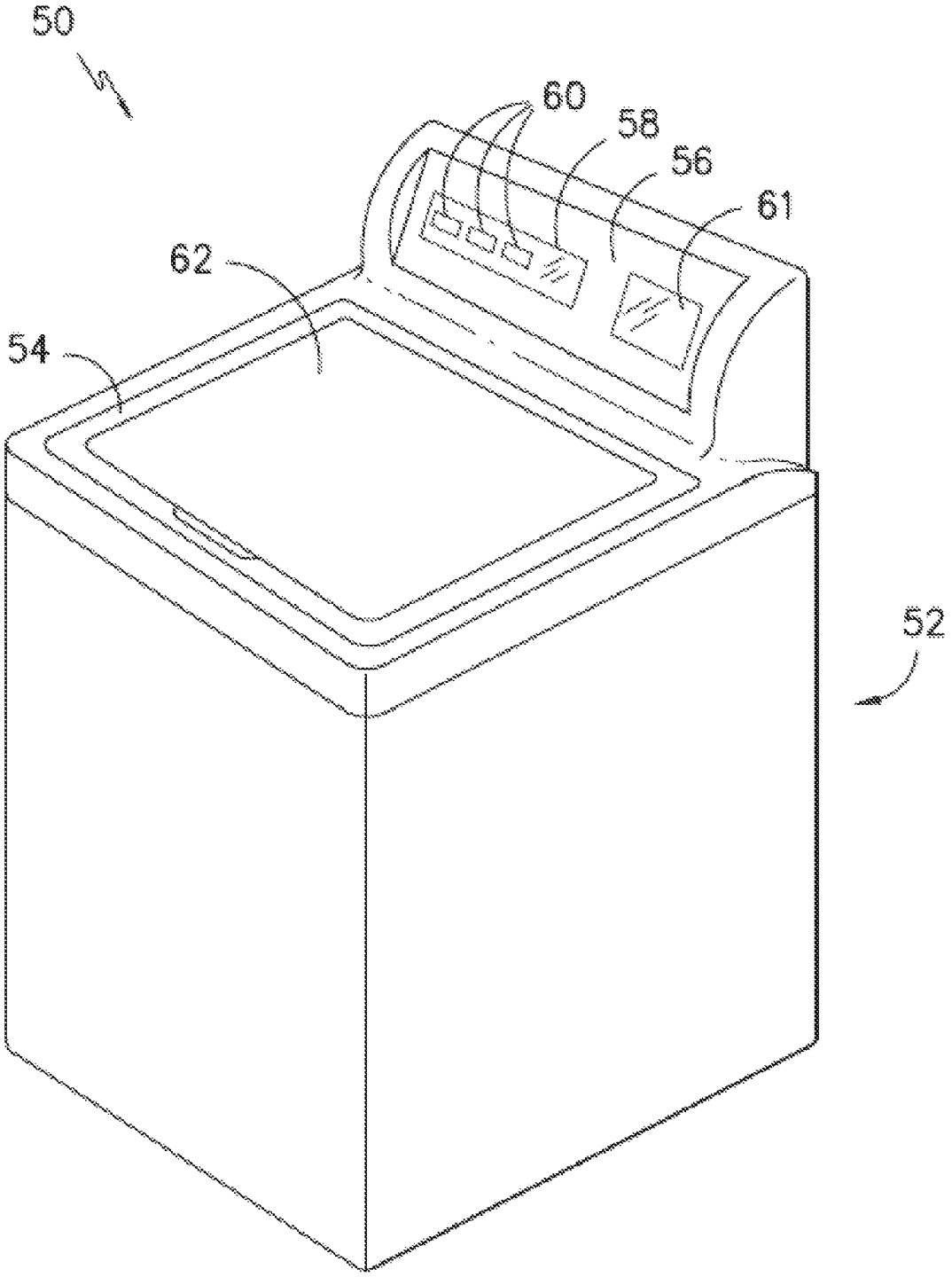
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
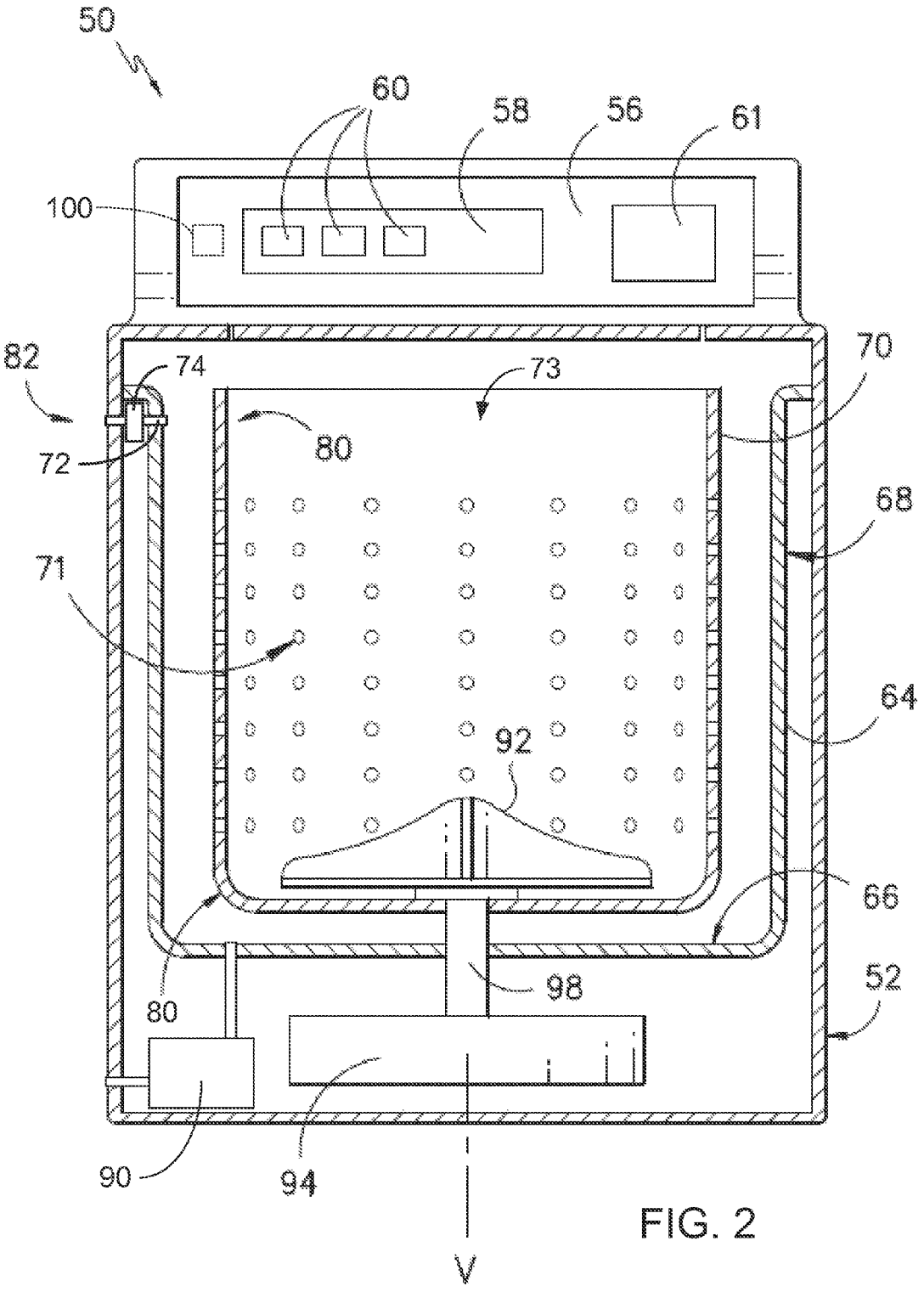
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about a vertical axis V. Thus, washing machine appliance is generally referred to as a vertical axis washing machine appliance. Wash basket 70 defines a wash chamber 73 for receipt of articles for washing and extends, e.g., vertically, between a bottom portion 80 and a top portion 82. Wash basket 70 includes a plurality of perforations 71 therein to facilitate fluid communication between an interior of wash basket 70 and wash tub 64.

A spout 72 is configured for directing a flow of fluid into wash tub 64. In particular, spout 72 may be portioned at or adjacent top portion 82 of wash basket 70. Spout 72 may be in fluid communication with a water supply (not shown) in order to direct fluid (e.g., clean water) into wash tub 64 and/or onto articles within wash chamber 73 of wash basket 70. A valve 74 regulates the flow of fluid through spout 72. For example, valve 74 can selectively adjust to a closed position in order to terminate or obstruct the flow of fluid through spout 72. A pump assembly 90 (shown schematically in FIG. 2) is located beneath tub 64 and wash basket 70 for gravity assisted flow to drain wash tub 64.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Wash basket 70 and agitation element 92 are driven by a pancake motor 94. As motor output shaft 98 is rotated, wash basket 70 and agitation element 92 are operated for rotatable movement within wash tub 64, e.g., about vertical axis V. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 100, that is operatively coupled to the user interface input located on washing machine backsplash 56 (shown in FIG. 1) for user manipulation to select washing machine cycles and features. In response to user manipulation of the user interface input, controller 100 operates the various components of washing machine appliance 50 to execute selected machine cycles and features.

Controller 100 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 100 via one or more signal lines or shared communication busses.

In an illustrative embodiment, laundry items are loaded into wash chamber 73 of wash basket 70, and washing operation is initiated through operator manipulation of control input selectors 60. Wash tub 64 is filled with water and mixed with detergent to form a wash fluid. Valve 74 can be opened to initiate a flow of water into wash tub 64 via spout 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 is moved back and forth in an oscillatory motion.

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

Figure 3:
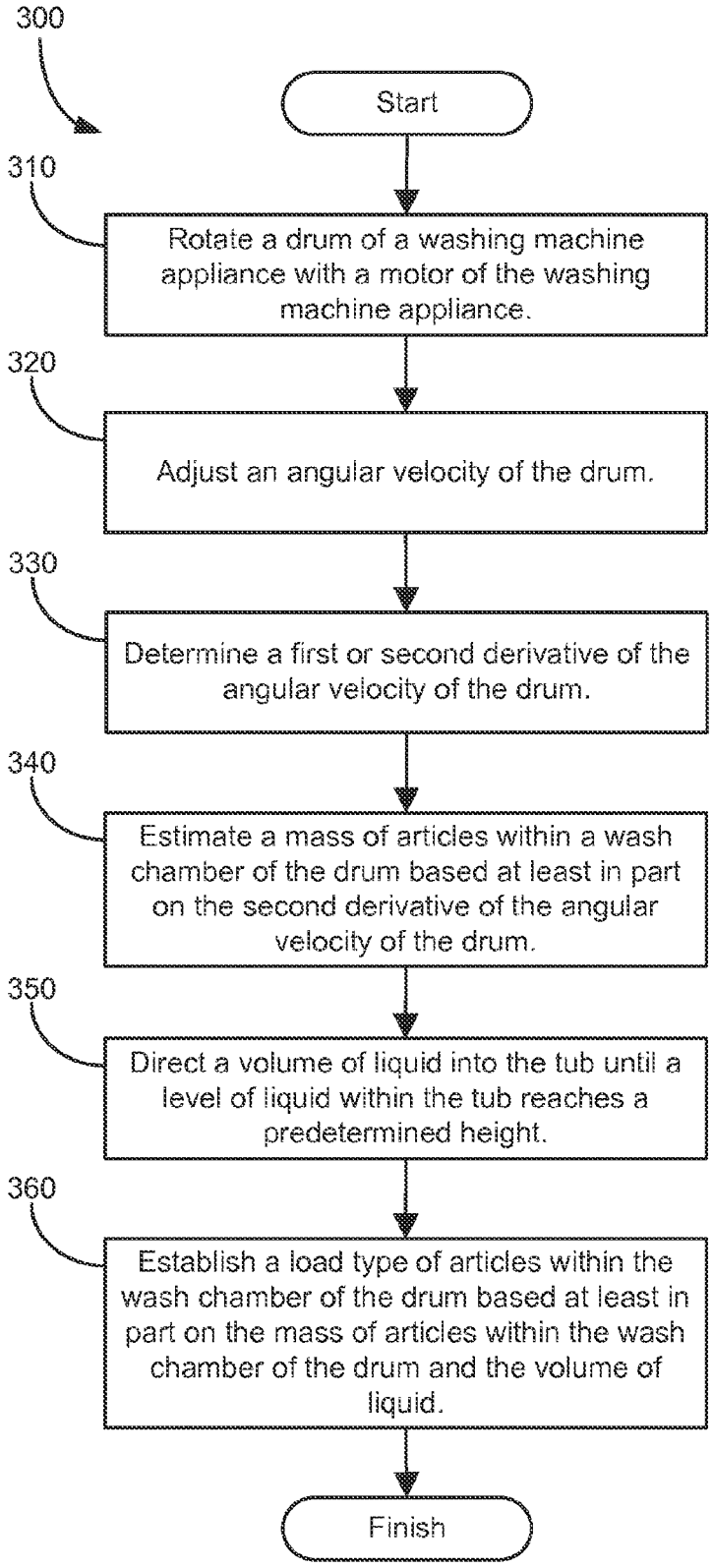
FIG. 3 illustrates a method of operating a washing machine appliance according to an exemplary embodiment of the present subject matter.

FIG. 3 illustrates a method 300 of operating a washing machine appliance according to an exemplary embodiment of the present subject matter. Method 300 can be used to operate any suitable washing machine appliance, such as washing machine appliance 50 (FIG. 1). Method 300 may be programmed into and implemented by controller 100 (FIG. 2) of washing machine appliance 50. Utilizing method 300, controller 100 can determine a load type of articles within wash chamber 73 of basket 70.

As used herein, the term "load type" corresponds to a composition or fabric type of articles, e.g., within wash chamber 73 of basket 70. As an example, if articles within wash chamber 73 of basket 70 have a relatively high absorptivity, the load type of such articles is a high absorption load type. Cotton articles can have a relatively high absorptivity such the load type of such articles is the high absorption load type. Conversely, if articles within wash chamber 73 of basket 70 have a relatively low absorptivity, the load type of such articles is a low absorption load type. Synthetic articles, such as nylon or polyester articles, can have a relatively low absorptivity such the load type of such articles is the low absorption load type. If a mixed or blended load of articles is disposed within wash chamber 73 of basket 70, the load type of such articles is a mixed or blended absorption load type. Thus, the blended absorption load type can correspond to a blend of cotton articles and synthetic articles within wash chamber 73 of basket 70.

As discussed above, method 300 can assist with determining the load type of articles within wash chamber 73 of basket 70. At step 310, controller 100 rotates basket 70 with motor 94. Thus, controller 100 can activate motor 94 at step 310 in order to rotate basket 70. Controller 100 can operate motor 94 at step 310 such that basket 70 rotates at a predetermined frequency or angular velocity. The predetermined frequency or angular velocity can be any suitable frequency or angular velocity. For example, the predetermined frequency or angular velocity may be about one hundred and twenty revolutions per minute.

At step 320, controller 100 adjusts an angular velocity of basket 70. Controller 100 can utilize motor 94 to adjust the angular velocity of basket 70. In certain exemplary embodiments, controller 100 can deactivate motor 94 at step 320 in order to adjust the angular velocity of basket 70. To deactivate motor 94, controller 100 can short windings of motor 94, e.g., using any suitable mechanism or method known to those skilled in the art.

At step 330, controller 100 determines an angular acceleration or first derivative of the angular velocity of basket 70 or a jerk or a second derivative of the angular velocity of basket 70, e.g., based at least in part the adjustment of the angular velocity of basket 70 at step 320. Based upon the first and/or second derivative of the angular velocity of basket 70, controller 100 estimates a mass of articles within wash chamber 73 of basket 70 at step 340. Thus, controller 100 can establish the mass of articles within wash chamber 73 of basket 70 based upon the inertia of articles within wash chamber 73 of basket 70 at step 340. As an example, the magnitude of the first and/or second derivative of the angular velocity of basket 70 can be inversely proportional to the mass of articles within wash chamber 73 of basket 70. Thus, controller 100 can correlate the magnitude of the first and/or second derivative of the angular velocity of basket 70 to the mass of articles within wash chamber 73 of basket 70 at step 340. At step 340, controller 100 can also establish a tolerance range for the mass of articles within wash chamber 73 of basket 70. The tolerance range for the mass of articles within wash chamber 73 of basket 70 can correspond to the error or uncertainty of the estimate of the mass of articles within wash chamber 73 of basket 70 at step 340.

At step 350, controller 100 directs a volume of liquid into wash tub 64. In particular, controller 100 directs liquid into wash tub 64 at step 350 until a level of liquid within wash tub 64 reaches a predetermined height, e.g., about six inches. As an example, controller 100 can open valve 74 in order to direct a flow of liquid into wash tub 64. After or when the level of liquid within wash tub 64 reaches the predetermined height, controller 100 can close valve 74 in order to terminate the flow of liquid into wash tub 64. Controller 100 can calculate the volume of liquid within wash tub 64, e.g., based on a flow rate of liquid through valve 74 and a time period between controller 100 opening and closing valve 74.

At step 360, controller 100 establishes the load type of articles within wash chamber 73 of basket 70. Controller 100 can establish the load type of articles within wash chamber 73 of basket 70 based at least in part on the mass of articles within wash chamber 73 of basket 70 from step 340 and the volume of liquid from step 350. Step 360 is discussed in greater detail below.

Figure 5:
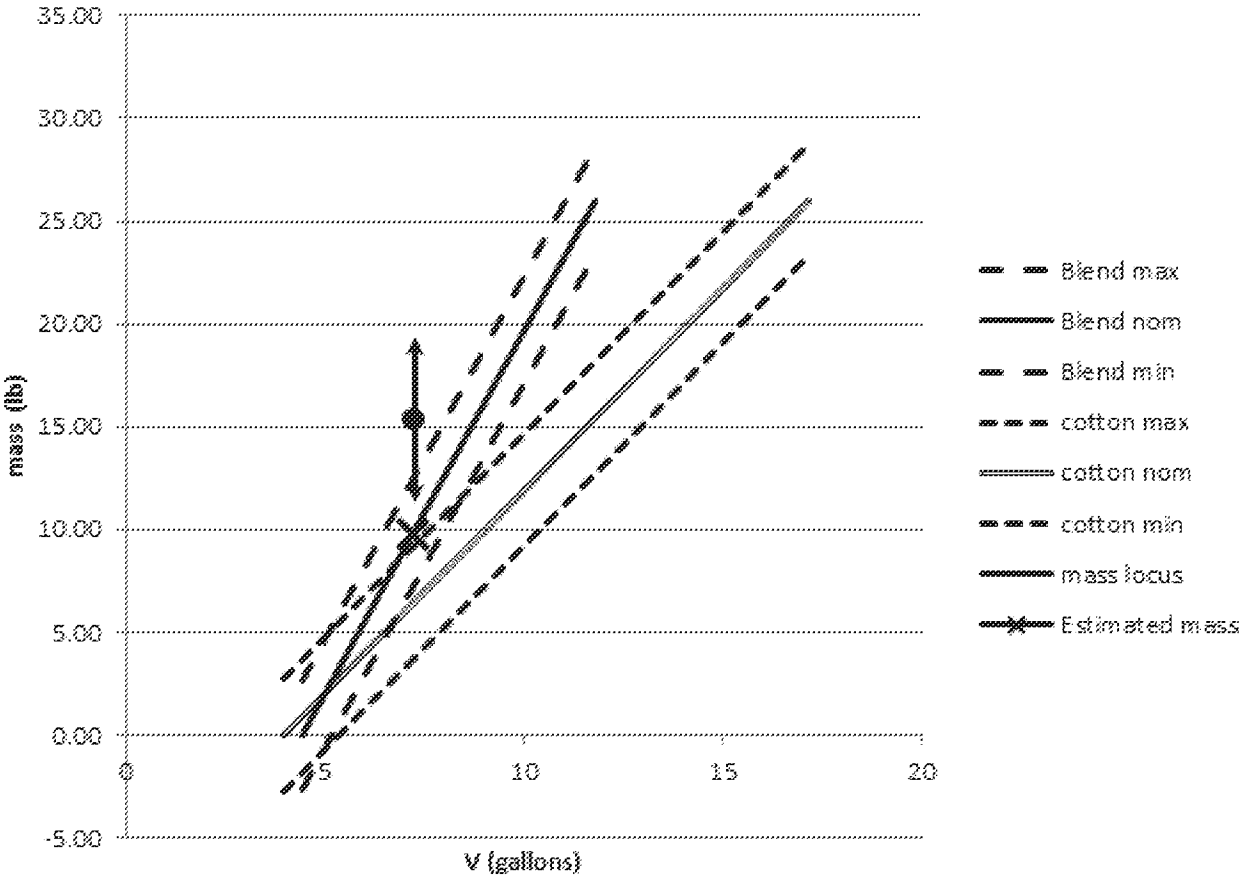
FIG. 5 illustrates an exemplary plot of volume-liquid level absorption correlations for various load types of articles within a wash chamber of a washing machine appliance and an estimated mass of articles within the wash chamber.

FIG. 5 illustrates an exemplary plot of volume-liquid level absorption correlations for various load types of articles within wash chamber 73 of basket 70 and the mass of articles within wash chamber 73 of basket 70 from step 340. As used herein, the term "volume-liquid level absorption correlation" corresponds to a relationship between the volume of liquid within wash tub 64 required to fill wash tub 64 to the predetermined height and the mass of articles within wash chamber 73 of basket 70. As an example, if articles within wash chamber 73 of basket 70 have a relatively high absorptivity, a relatively large volume of liquid can be required to fill wash tub 64 to the predetermined height. Conversely, for a load with an identical mass as the above example, a relatively small volume of liquid can be required to fill wash tub 64 to the predetermined height if articles within wash chamber 73 of basket 70 have a relatively low absorptivity. If a blended load of articles is disposed within wash chamber 73 of basket 70, a volume of liquid between the relatively large volume of liquid and the relatively small volume of liquid can be required to fill wash tub 64 to the predetermined height.

At step 360, controller 100 can provide the plurality of liquid volume-liquid level absorption correlations. For example, the plurality of liquid volume-liquid level absorption correlations can be established experimentally and may be stored in the memory of controller 100 during production of washing machine appliance 50. Each absorption correlation of the plurality of liquid volume-liquid level absorption correlations corresponds to a respective load type of articles within wash chamber 73 of basket 70. In the exemplary embodiment shown in FIG. 5, the plurality of liquid volume-liquid level absorption correlations includes a cotton liquid volume-liquid level absorption correlation and a blended liquid volume-liquid level absorption correlation.

At step 360, controller 100 can also ascertain predicted masses of articles within wash chamber 73 of basket 70 based at least in part on the plurality of liquid volume-liquid level absorption correlations. Each predicted mass of the predicted masses of articles within wash chamber 73 of basket 70 corresponds to a respective one of the plurality of liquid volume-liquid level absorption correlations. In the exemplary embodiment shown in FIG. 5, the predicted masses of articles within wash chamber 73 of basket 70 correspond to the masses of a cotton load and a blended load associated with the volume of liquid from step 350. In particular, the volume of liquid from step 350 in the exemplary embodiment shown in FIG. 5 is about seven gallons. The predicted mass for articles within wash chamber 73 of basket 70 if the articles are cotton is about six pounds in the exemplary embodiment shown in FIG. 5. Conversely, the predicted mass for articles within wash chamber 73 of basket 70 if the articles are blended is about ten pounds in the exemplary embodiment shown in FIG. 5.

At step 360, controller 100 can also compare the mass of articles within wash chamber 73 of basket 70 of step 340 and the predicted masses of articles within wash chamber 73 of basket 70. In particular, controller 100 can determine differences between the mass of articles within wash chamber 73 of basket 70 of step 340 and the predicted masses of articles within wash chamber 73 of basket 70. Controller 100 can establish the load type of articles within wash chamber 73 of basket 70 based at least in part on the differences between the mass of articles within wash chamber 73 of basket 70 of step 340 and the predicted masses of articles within wash chamber 73 of basket 70.

In the exemplary embodiment shown in FIG. 5, controller 100 can select a cotton load type, a blended load type, or a synthetic load type based at least in part on differences between the mass of articles within wash chamber 73 of basket 70 of step 340 and the predicted masses of articles within wash chamber 73 of basket 70. As shown in FIG. 5, the tolerance range of the mass of articles within wash chamber 73 of basket 70 of step 340 is within the tolerance range of the predicted mass of articles within wash chamber 73 of basket 70 for the blended load type. Thus, controller 100 can establish the load type of articles within wash chamber 73 of basket 70 as the blended load type at step 360 for the exemplary shown in FIG. 5.

At step 360, if any portion of the tolerance range of the mass of articles within wash chamber 73 of basket 70 of step 340 is within the tolerance range of the predicted mass of articles within wash chamber 73 of basket 70 for the blended load type, controller 100 can establish the load type of articles within wash chamber 73 of basket 70 as the blended load type at step 360 for the exemplary shown in FIG. 5. Conversely, if the tolerance range of the mass of articles within wash chamber 73 of basket 70 of step 340 is only within the tolerance range of the predicted mass of articles within wash chamber 73 of basket 70 for the cotton load type, controller 100 can establish the load type of articles within wash chamber 73 of basket 70 as the cotton load type at step 360 for the exemplary shown in FIG. 5. Similarly, if the entire tolerance range of the mass of articles within wash chamber 73 of basket 70 of step 340 is greater than the tolerance range of the predicted mass of articles within wash chamber 73 of basket 70 for the blended load type, controller 100 can establish the load type of articles within wash chamber 73 of basket 70 as the synthetic load type at step 360 for the exemplary shown in FIG. 5.

In method 300, controller 100 can direct a first volume of water into wash tub 64 of washing machine appliance 50 during a wash cycle of washing machine appliance 50 if the load type of articles within wash chamber 73 of basket 70 is the cotton load type at step 360. Conversely, controller 100 can direct a second volume of water into wash tub 64 of washing machine appliance 50 during the wash cycle of washing machine appliance 50 if the load type of articles within wash chamber 73 of basket 70 is the blended load type at step 360. Furthermore, controller 100 can direct a third volume of water into wash tub 64 of washing machine appliance 50 during the wash cycle of washing machine appliance 50 if the load type of articles within wash chamber 73 of basket 70 is the synthetic load type at step 360. The first, second and third volumes are different. In particular, the first volume may be greater than the second volume. In such a manner, controller 100 can direct less water into wash tub 64 if the load type of articles within wash chamber 73 of basket 70 is the blended load type at step 360. Thus, method 400 can conserve water if the load type of articles within wash chamber 73 of basket 70 is the blended load type at step 360, and method 400 ensure that sufficient water is directed into wash tub 64 if the load type of articles within wash chamber 73 of basket 70 is the cotton load type at step 360. Similarly, the second volume may be greater than the third volume. In such a manner, controller 100 can direct less water into wash tub 64 if the load type of articles within wash chamber 73 of basket 70 is the synthetic load type at step 360.

Figure 4:
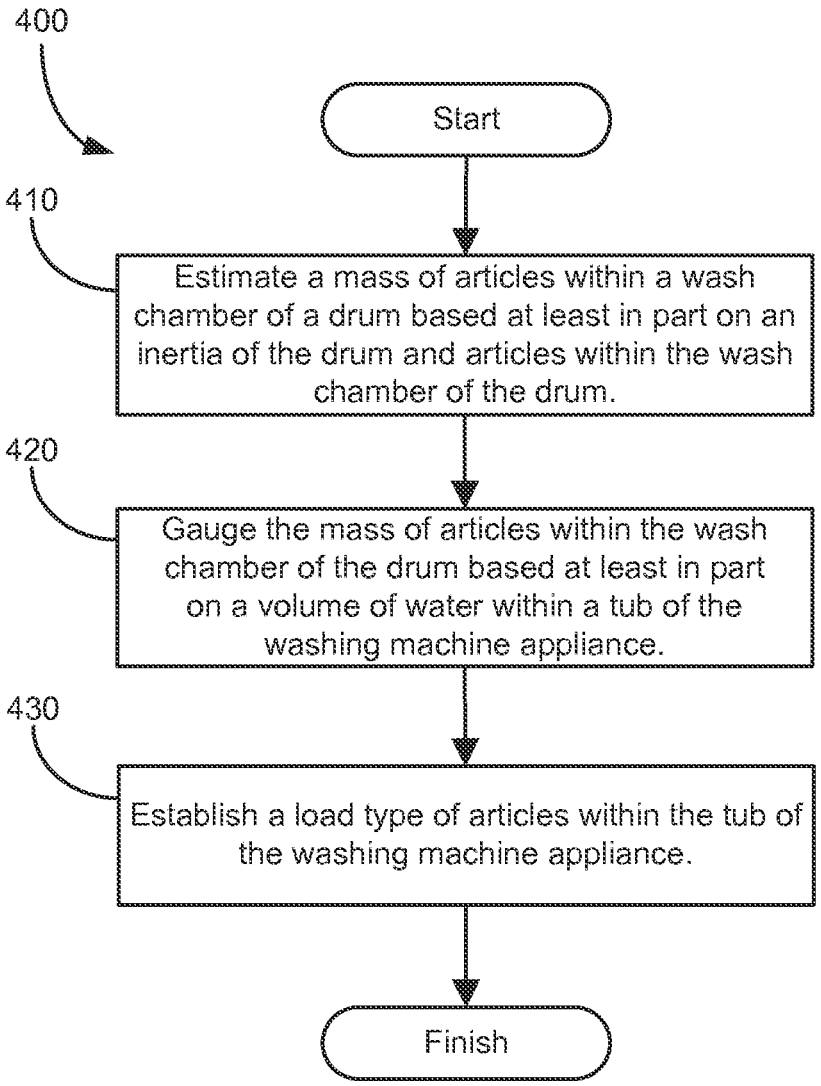
FIG. 4 illustrates a method of operating a washing machine appliance according to another exemplary embodiment of the present subject matter.

FIG. 4 illustrates a method 400 of operating a washing machine appliance according to another exemplary embodiment of the present subject matter. Method 400 can be used to operate any suitable washing machine appliance, such as washing machine appliance 50 (FIG. 1). Method 400 may be programmed into and implemented by controller 100 (FIG. 2) of washing machine appliance 50. Utilizing method 400, controller 100 can determine a load type of articles within wash chamber 73 of basket 70.

At step 410, controller 100 estimates a mass of articles within wash chamber 73 of basket 70 based at least in part on an inertia of basket 70 and articles within wash chamber 73 of basket 70. At step 420, gauges the mass of articles within wash chamber 73 of basket 70 based at least in part on a volume of water within wash tub 64. The volume of water fills wash tub 64 to a predetermined level at step 420. At step 430, controller 100 establishes a load type of articles within wash chamber 73 of basket 70 based at least in part on the mass of articles within wash chamber 73 of basket 70 of step 410 and the mass of articles within wash chamber 73 of basket 70 of step 420.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine appliance, the washing machine appliance having a drum positioned within a tub, the drum defining a wash chamber for receipt of articles for washing, a motor of the washing machine appliance configured for rotating the drum within the tub, the method comprising:

rotating the drum with the motor;

adjusting an angular velocity of the drum during said step of rotating;

determining a first or second derivative of the angular velocity of the drum after said step of adjusting;

estimating a mass of articles within the wash chamber of the drum based at least in part on the first or second derivative of the angular velocity of the drum from said step of determining;

directing liquid into the tub until a volume of liquid fills the tub to a predetermined height; and establishing a load type of articles within the wash chamber of the drum based at least in part on the mass of articles within the wash chamber of the drum from said step of estimating and the volume of liquid from said step of directing.

2. The method of claim 1, wherein said step of adjusting the angular velocity of the drum comprises deactivating the motor.

3. The method of claim 2, wherein said step of deactivating the motor comprises shorting windings of the motor.

4. The method of claim 1, wherein said step of rotating the drum with the motor comprises rotating the drum with the motor at a predetermined frequency.

5. The method of claim 4, wherein the predetermined frequency is about one hundred and twenty rotations per minute.

6. The method of claim 1, wherein said step of estimating the mass of articles within the wash chamber of the drum further comprises establishing a tolerance range for the mass of articles within the wash chamber of the drum.

7. The method of claim 1, wherein said step of establishing the load type of articles within the wash chamber of the drum comprises:

providing a plurality of liquid volume-liquid level absorption correlations, each absorption correlation of the plurality of liquid volume-liquid level absorption correlations corresponding to a respective load type of articles within the wash chamber of the drum;

ascertaining predicted masses of articles within the wash chamber of the drum based at least in part on the plurality of liquid volume-liquid level absorption correlations from said step of providing, each predicted mass of the predicted masses of articles within the wash chamber of the drum corresponding to a respective one of the plurality of liquid volume-liquid level absorption correlations from said step of providing; and comparing the mass of articles within the wash chamber of the drum from said step of estimating and the predicted masses of articles within the wash chamber of the drum from said step of ascertaining.

8. The method of claim 7, wherein the plurality of liquid volume-liquid level absorption correlations comprises a first liquid volume-liquid level absorption correlation and a second liquid volume-liquid level absorption correlation.

9. The method of claim 8, wherein said step of establishing the load type of articles within the wash chamber of the drum further comprises selecting one of a first load type or a second load type based at least in part on differences between the mass of articles within the wash chamber of the drum from said step of estimating and the predicted masses of articles within the wash chamber of the drum from said step of ascertaining.

10. The method of claim 9, further comprising directing a first volume of water into the tub of the washing machine appliance during a wash cycle of the washing machine appliance if the load type of articles within the wash chamber of the drum is the first load type at said step of selecting or directing a second volume of water into the tub of the washing machine appliance during the wash cycle of the washing machine appliance if the load type of articles within the wash chamber of the drum is the second load type at said step of selecting, the first and second volumes being different.

11. The method of claim 10, wherein the first volume is greater than the second volume.

12. A method for operating a washing machine appliance, the washing machine appliance having a drum positioned within a tub, the drum defining a wash chamber for receipt of articles for washing, a motor of the washing machine appliance configured for rotating the drum within the tub, the method comprising:

estimating a mass of articles within the wash chamber of the drum based at least in part on an inertia of the drum and articles within the wash chamber of the drum;

gauging the mass of articles within the wash chamber of the drum based at least in part on a volume of water within the tub, the volume of water filling the tub to a predetermined level; and establishing a load type of articles within the wash chamber of the drum based at least in part on the mass of articles within the wash chamber of the drum from said step of estimating and the mass of articles within the wash chamber of the drum from said step of gauging.

* * * * *